US008297243B2

(12) United States Patent
Kang

(10) Patent No.: US 8,297,243 B2
(45) Date of Patent: Oct. 30, 2012

(54) SWITCHABLE CAM FOLLOWER OF A VALVE TRAIN OF AN INTERNAL COMBUSTION ENGINE

(75) Inventor: Bogyu Kang, Rochester Hills, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 304 days.

(21) Appl. No.: 12/725,571

(22) Filed: Mar. 17, 2010

(65) Prior Publication Data

US 2010/0236508 A1 Sep. 23, 2010

Related U.S. Application Data

(60) Provisional application No. 61/161,675, filed on Mar. 19, 2009.

(51) Int. Cl.
*F01L 1/34* (2006.01)

(52) U.S. Cl. ..... 123/90.16; 123/90.15; 123/90.39

(58) Field of Classification Search ..... 123/90.16, 123/90.44, 90.47, 90.2
See application file for complete search history.

(56) References Cited

U.S. PATENT DOCUMENTS

| | | | | |
|---|---|---|---|---|
| 5,544,626 | A | 8/1996 | Diggs et al. | |
| 6,923,151 | B2 * | 8/2005 | Kreuter | 123/90.16 |
| 7,147,869 | B2 * | 12/2006 | Dietrich et al. | 424/466 |
| 7,174,869 | B2 * | 2/2007 | Proschko et al. | 123/90.39 |
| 7,201,126 | B1 * | 4/2007 | Seitz | 123/90.39 |
| 7,318,402 | B2 * | 1/2008 | Harman et al. | 123/90.39 |
| 7,921,821 | B2 * | 4/2011 | Rorig et al. | 123/90.44 |

FOREIGN PATENT DOCUMENTS

| | | |
|---|---|---|
| DE | 10345307 | 4/2005 |
| DE | 102006023772 | 11/2007 |

* cited by examiner

*Primary Examiner* — Thomas Denion
*Assistant Examiner* — Steven D Shipe
(74) *Attorney, Agent, or Firm* — Lucas & Mercanti, LLP; Klaus P. Stoffel

(57) ABSTRACT

A switchable cam follower of a valve train of a combustion engine, which has an external lever that encompasses an internal lever between its arms. The levers are pivotally moveable relative to one another on an axis applied to a valve-side end. The cam follower also has a stop for a gas exchange valve on an underside on the valve-side end and on the other end has a complementary face for a support element. Additionally, the cam follower has a start face on an upper side for at least one high-lift cam. In one receptacle of one of the cams, a coupling element is seated, which can be brought into engagement in sections in case of coupling with a driving surface of the other lever. Further, a lost-motion spring is clamped between the two levers and is positioned in the region of the other end of the cam follower.

10 Claims, 2 Drawing Sheets

SWITCHABLE CAM FOLLOWER OF A VALVE TRAIN OF AN INTERNAL COMBUSTION ENGINE

This application claims priority of U.S. Provisional Patent Application No. 61/161,675 filed Mar. 19, 2009, the entire contents of which is hereby incorporated by reference.

FIELD OF THE INVENTION

The invention relates to a switchable cam follower of a valve train of an internal combustion engine, with an external lever which is encompassing an internal lever between its arms, which levers are pivotably moveable relative to one another on an axis that is applied to a valve-side end, wherein the cam follower has a stop for a gas exchange valve on an underside on the valve-side end and on the other end has a complementary face for a support element, wherein the cam follower has a start face on an upper side for at least one high-lift cam, wherein in one receptacle of one of the cams a coupling means is seated, which can be brought into engagement in sections in case of coupling (high-lift) with a driving surface of the respective other lever and wherein a lost-motion spring means is clamped between the two levers.

BACKGROUND OF THE INVENTION

A cam follower of this kind, in this case embodied as a lift deactivation means, is already known from U.S. Pat. No. 5,544,626. The lost-motion spring means of this cam follower is embodied as a two-part torsion spring and extends on the valve-side end of the cam follower. As a result of the application of the torsion spring on the one end, a relatively high mass moment of inertia is present. As a result, friction on the valve train is unnecessary high. Furthermore, it was found that the lost-motion spring means mentioned above has a relatively complex geometry and that its installation is complex. Also, installation space is utilized which is essentially outside of the geometry of the cam follower.

Further switchable cam followers with lost-motion spring means on the valve-side end emerge from, for example, DE 103 45 307 A1 and DE 10 2006 023 772 A1.

OBJECT OF THE INVENTION

It is therefore the object of the invention, to develop a switchable cam follower of the kind mentioned above, in which the mentioned disadvantages are eliminated. In particular, a cam follower is to be developed, whose mass moment of inertia is reduced in a design that is simple at the same time.

INVENTIVE SOLUTION

According to the invention, the object is achieved in that the lost-motion spring means is positioned in the region of the other end of the cam follower, wherein according to a first, particularly preferred embodiment of the invention, the lost-motion spring means is formed at least as a helical compression spring or a helical compression spring packet.

Consequently, a switchable cam follower is available, in which the disadvantages mentioned in the outset are eliminated. The mass of the lost-motion spring means, which is preferably formed at least as one helical compression spring or one helical compression spring packet, does not affect the mass moment of inertia of the cam follower so as to increase it unnecessarily. The corresponding helical compression spring is available as a standard spring means, so that the cost, compared to the torsion spring, is reduced. Installation and handling of the helical compression springs is comparatively easy.

According to a further preferred variant of the invention, two helical compression springs or two helical compression spring packets are to be used, which extend on both sides of the outer side wall of the internal lever, which means still inside of the extension of the cam follower, in the immediate vicinity of the spherical cap. Therefore, a further contribution is made towards a compact cam follower. However, it is also conceivable and provided, to apply the lost-motion spring means according to the invention behind the other end of the cam follower. Therefore, the cam follower would possibly require a narrower installation space.

According to a further implementation of the invention, the cam follower is designed as a so-called "lift switch". The external lever of said lift switch, for example, has two pads (sliding surfaces) as stop faces for the cam for associated high-lift cams, whereas for a stop face for the low-lift cam, a rotatable roller mounted on a bearing is provided in the internal lever. If appropriate, in both cases pads or rollers may be provided or the internal lever may have a pad and the external lever have rollers. The extent of protection of the invention, however, also refers to a cam follower which is formed as a so-called "lift deactivation means".

The tower-shaped projection extends outward particularly preferably in one piece as contact face at one end for the corresponding lost-motion spring means from an upper side of the corresponding arm of the external lever. Also, the shoulder of the internal lever to the stop of the lost-motion spring means on the other side is to extend outwards in one piece, wherein multi-part variations are also conceivable.

A further sub-claim refers to a functional embodiment and arrangement of the coupling means. Accordingly, said coupling means is to be formed as a slider, which is seated in the internal lever preferably above the complementary face which is embodied as a spherical cap and which coupling means is, in the case of coupling, engageable with a driving surface of an end-side bracket of the external lever. The arrangement of the coupling means in the region of the spherical cap and, therefore, of the pivot center of the cam follower is a further contribution to the lowering of the mass moment of inertia. The coupling means may be, for example, a piston, whose engaging section may be cylindrical or flattened.

It is further provided in a development of the invention, to provide a stop for the external lever on the internal lever, so that, for instance, a flush position of the receptacle of the coupling means with respect to the driving surface or, at least, a simple rotation stop is given. An attachment, which is projecting from an upper end side of the internal lever, is provided for the stop, the underside of which attachment communicating with an upper side of the bracket on the end side of the external lever, in the case of engagement.

Although a spherical cap-shaped recess on the underside of the internal lever is particularly expedient as a complementary surface for the support element, it is also conceivable and provided to apply a joint or the like in this area. At this point, it is appropriate to feed hydraulic fluid for the "actuation" of the coupling means from the support element via the spherical cap-like molding in at least one displacement direction.

SHORT DESCRIPTION OF THE DRAWING

The invention is expediently explained by means of the drawing, in which.

DETAILED DESCRIPTION OF THE DRAWING

Figure 1:
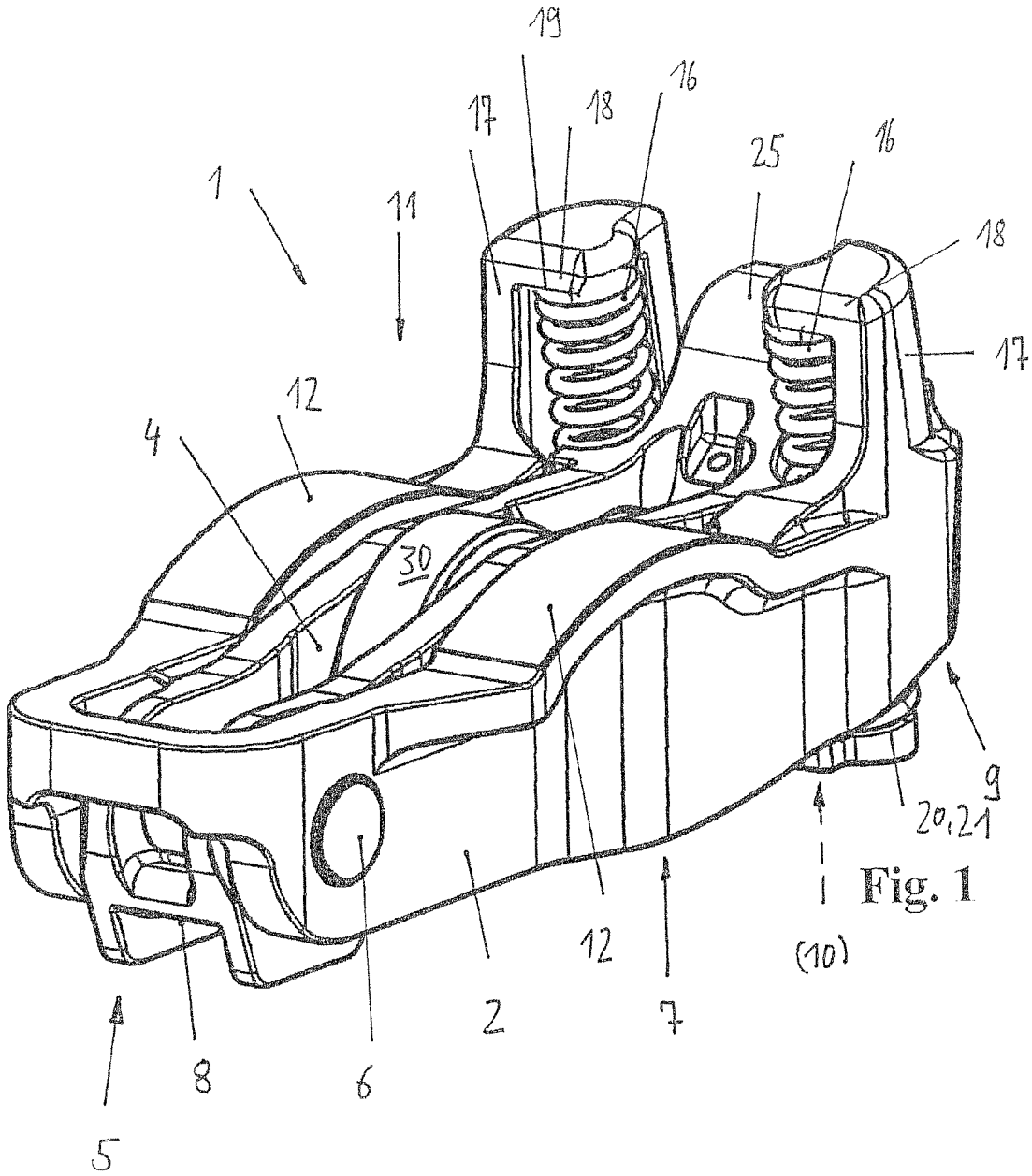
FIG. 1 shows a spatial assembly drawing of the cam follower.
Figure 2:
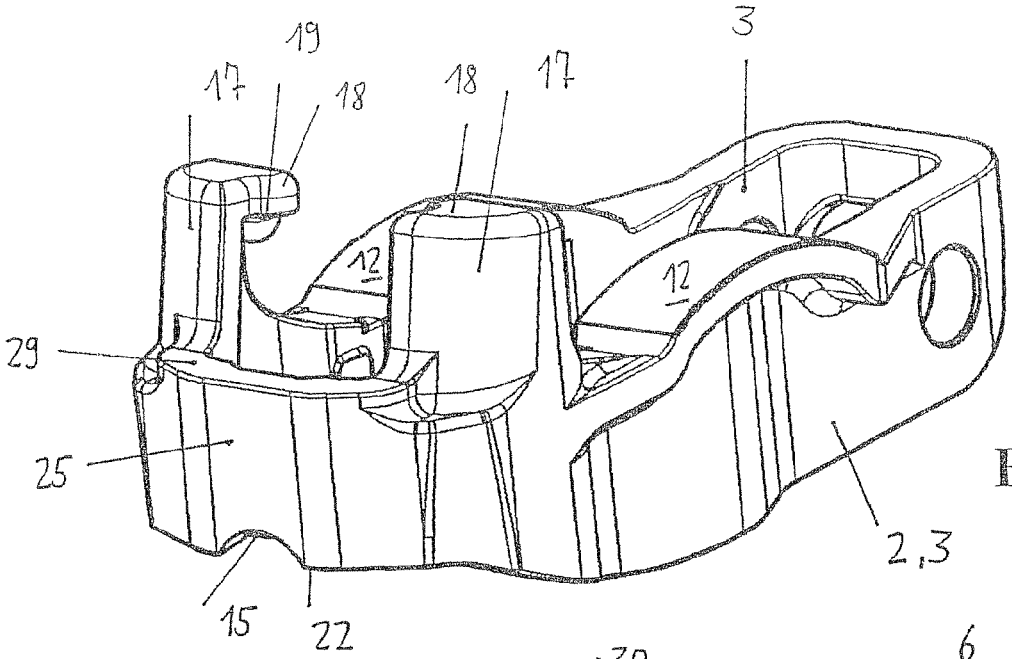
FIG. 2 shows a spatial view of the external lever.

A switchable cam follower 1 in box construction is shown. The cam follower 1 comprises an elongate external lever 2, which encloses between its arms 3 an internal lever 4 pivotably movable relative to it. Both levers 2, 4 are mounted in the region of a valve-side end 5 on a mutual axis 6.

The internal lever 4 has on its underside at the valve-side end 5 a stop 8 for a gas exchange valve. On the other end 9, the internal lever 4 has a complementary face 10 embodied as spherical cap here, for mounting on a head of a hydraulic support element. Approximately in the region of a longitudinal center, the arms 3 of the external lever 2 have a start face 12 (sliding surface) embodied as a pad for associated high lift cams. The internal lever, in turn, which is also formed from two elongate arms, has a roller mounted on a roller bearing or a plain bearing as a start face 30 for a low-lift cam.

The internal lever 4 has a receptacle 13 extending in the longitudinal direction above the complementary face 10 for a piston serving as coupling means 14. The latter is displaceable in sections in case of coupling under a driving surface 15 of a bracket 25 which connects the arms 3 of the external lever 2 at the other end 9. In case of coupling, lift of the high-lift cam is transmitted, as is known to a person skilled in the art, which cam is contacting the arms 2 of the external lever 2, wherein in case of decoupling, only the internal lever 4 is active and the gas exchange valve opens in terms of the low-lift cam contacting the internal lever 4.

Two helical compression springs are provided as lost-motion spring means 16. These extend in the region of the other end 9, on each side of a respective outer side wall 23 of the internal lever 4, in the longitudinal section of the complementary surface 10 (see FIG. 3). A shoulder 21 is extending from each outer side wall 23 of the internal lever 4, on which the respective helical compressing spring is supported with its underside. With its upper side, the helical compression spring is acting on the underside 19 of a cranked section 18 of a attachment 17 of the external lever 2. The last-mentioned projection 17 is extending in one piece in a tower-shaped fashion from an upper side 11 of the respective arm 3 in the immediate region of the other end 9. A cam follower of compact design with integrated lost-motion spring means 16 is consequently created.

Figure 3:
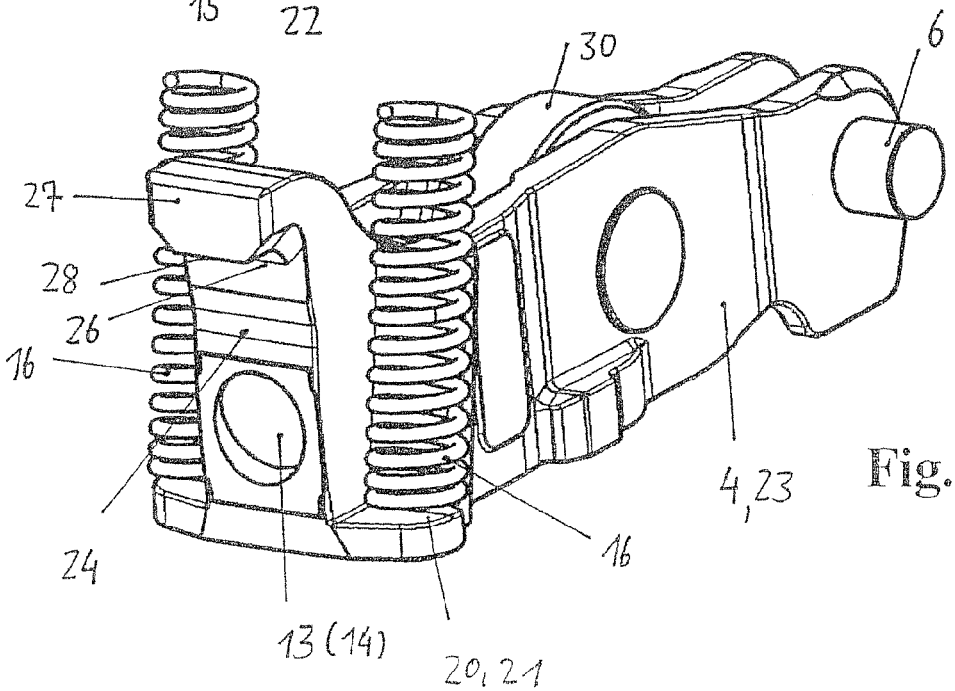
FIG. 3 shows a spatial view of the internal lever with axis and lost-motion spring means.

As FIG. 3 shows, a projection 27 extends from an upper side of an outer side wall 23 of the internal lever 4 in the direction remote from the lever. The external lever 2 bears with an upper side 29 of its bracket 25 on an underside 28 of the extension 27, in order to create, for instance, a flush coupling position of the receptacle 13 with respect to the driving surface 15, or a simply a rotation stop.

Because of the arrangement of the helical compression springs as lost-motion spring means 16 in the immediate region of a pivot center of the cam follower 1, the cam follower has only a relatively low mass moment of inertia. At the same time, the helical compression springs, as a bulk article, are very inexpensive and their handling and assembly proves to be very simple.

LIST OF REFERENCE NUMBERS

1) Cam follower
2) External lever
3) Arm
4) Internal lever
5) Valve-side end
6) Axis
7) Underside
8) Stop
9) Other end
10) Complementary face
11) Upper side
12) Start face
13) Receptacle
14) Coupling means
15) Driving surface
16) Lost-motion spring means
17) Attachment
18) Cranked section
19) Underside of cranked section
20) Upper side shoulder
21) Shoulder
22) Underside bracket
23) Outer side wall
24) End side of internal lever
25) Bracket
26) Upper side end
27) Extension
28) Underside extension
29) Upper side bracket
30) Contact surface

The invention claimed is:

1. A switchable cam follower for a valve train of a combustion engine, which a valve-side end and a non-valve-side end with the cam follower rotatable about an axis of rotation at the valve-side end, the cam follower comprising:

an internal lever having a stop for a gas exchange valve on an underside thereof at the valve-side end of the cam follower, a complementary face for a support element at the non-valve-side end of the cam follower, and a receptacle in which a coupling element is seated at the non-valve-side end of the cam follower;

an external lever having arms, a start face on an upper side of the arms for at least one high-lift cam, and an attachment extending transverse to the axis of rotation from the upper side of the arms at the non-valve-side end of the cam follower beyond the start face on the upper side of the arms, between the arms, the external lever encompassing the internal lever, the internal lever and the external lever being pivotably moveable relative to one another about the axis of rotation at the valve-side end of the cam follower, and the coupling element of the internal lever being engageable in sections in a first state when coupling with a driving surface of the external lever; and a lost-motion spring means being clamped between the internal lever and the external lever in a region of the non-valve-side end of the cam follower.

2. The cam follower of claim 1, wherein the lost-motion spring means is embodied as at least one helical compression spring or at least one helical compression spring packet.

3. The cam follower of claim 2, wherein the respective lost-motion spring means extends substantially orthogonally with respect to a transverse center plane of the cam follower, and wherein the attachment has a cranked section with an underside with the lost-motion spring means bearing against the underside, which acts against an upper side of a shoulder of the internal lever at the non-valve-side of the cam follower.

4. The cam follower of claim 3, wherein the attachment of the upper side of the external lever projects in a longitudinal sectional region of the complementary face, wherein the cranked section of the attachment faces inwards to an outer side wall of the internal lever, and wherein the shoulder of the internal lever extends from the outer side wall in the section, close to the underside of the internal lever.

5. The cam follower of claim 2, wherein the lost-motion spring means is embodied as two helical compression springs or two helical compression spring packets.

6. The cam follower of claim 4, wherein the lost-motion spring means is embodied as two helical compression springs or two helical compression spring packets that extend on both sides of the outer side wall of the internal lever.

7. The cam follower of claim 1, wherein the coupling means is at least one slider, the receptacle in which the slider is seated extending in a longitudinal direction of the internal lever above or a direction lateral to the complementary face and leads to an end side of the internal lever at the non-valve-side end, wherein the external lever has a bracket that connects the arms of the external lever and encompasses the end side of the internal lever, and wherein the driving surface for the coupling element is either a partially cylindrical molding on an underside of the bracket, or a bore or complementary opening in the bracket.

8. The cam follower of claim 7, wherein an extension protrudes from an upper side of the end side of the internal lever in the longitudinal direction of the internal lever, and the extension has an underside to which the bracket of the external lever abuts with the upper side in an event of cam base circle passage.

9. The cam follower of claim 1, wherein the cam follower is a lift switch, and both of the arms of the external lever are each contactable by a high-lift cam and the internal lever by a low-lift cam.

10. The cam follower of claim 9, wherein the start face is a sliding pad provided on the arms of the external lever, and the internal lever has a roller as contact surface.

* * * * *